US008801132B2

(12) United States Patent
Ohnishi

(10) Patent No.: US 8,801,132 B2
(45) Date of Patent: Aug. 12, 2014

(54) INKJET PRINTER, PRINTING METHOD, METHOD FOR PRODUCING PRINT DELIVERABLE, AND PRINT DELIVERABLE

(75) Inventor: Masaru Ohnishi, Nagano (JP)

(73) Assignee: Mimaki Engineering Company, Ltd., Tomi, Nagano (JP)

( * ) Notice: Subject to any disclaimer, the term of this patent is extended or adjusted under 35 U.S.C. 154(b) by 149 days.

(21) Appl. No.: 13/393,709

(22) PCT Filed: Sep. 2, 2010

(86) PCT No.: PCT/JP2010/005410

§ 371 (c)(1),
(2), (4) Date: Jun. 18, 2012

(87) PCT Pub. No.: WO2011/027561

PCT Pub. Date: Mar. 10, 2011

(65) Prior Publication Data

US 2012/0249640 A1 Oct. 4, 2012

(30) Foreign Application Priority Data

Sep. 2, 2009 (JP) ..... 2009-202720

(51) Int. Cl.
*B41J 2/045* (2006.01)

(52) U.S. Cl.
USPC ..... 347/14; 347/15; 347/40

(58) Field of Classification Search
USPC ..... 347/14, 15, 19, 40
See application file for complete search history.

(56) References Cited

U.S. PATENT DOCUMENTS

2005/0185005 A1 8/2005 Yamazaki et al.
2005/0190216 A1 9/2005 Yamazaki et al.
2007/0057986 A1 3/2007 Arazaki et al.
2007/0211101 A1* 9/2007 Yamanobe ..... 347/19
2008/0211844 A1 9/2008 Yamazaki et al.

FOREIGN PATENT DOCUMENTS

JP 11-58704 A 3/1999
JP 2005-205711 A 8/2005
JP 2005-212171 A 8/2005
JP 2005-280292 A 10/2005
JP 2007-98937 A 4/2007

OTHER PUBLICATIONS

International Search Report in corresponding PCT/JP2010/005410 from the Japanese Patent Office, mailed Nov. 16, 2010 (2 pages).

* cited by examiner

*Primary Examiner* — Lam S Nguyen
(74) *Attorney, Agent, or Firm* — Finnegan, Henderson, Farabow, Garrett, & Dunner, LLP

(57) ABSTRACT

(Problem to be Solved)
To appropriately restrain occurrence of striped variation and to appropriately enhance image quality of a printed result.
(Solution)
An inkjet printer in which multi-gradation printing is performed in an inkjet method includes an ejection control section for controlling ejection of ink droplets by supplying an ejection control signal to a nozzle for controlling ejection of the ink droplets from the nozzle of an inkjet head. The inkjet head forms lines of ink dots juxtaposed in a line direction so that the lines are juxtaposed in a direction perpendicular to the line direction. In a case that a nozzle which forms a line is the abnormal nozzle, an ejection control signal corresponding to an ink dot size which is different from a case of the normal nozzle is supplied as the ejection control signal corresponding to a part of the dots juxtaposed in the line, thereby an average value in the line of ejection errors is brought close to zero.

6 Claims, 5 Drawing Sheets

INKJET PRINTER, PRINTING METHOD, METHOD FOR PRODUCING PRINT DELIVERABLE, AND PRINT DELIVERABLE

TECHNICAL FIELD

The present invention relates to an inkjet printer, a printing method, a manufacturing method for a printed product and a printed product.

BACKGROUND ART

In recent years, an inkjet printer which performs printing in an inkjet method has been widely used. The inkjet printer performs printing by ejecting ink droplets from a nozzle of an inkjet head.

CITATION LIST

[Patent Literature]
[PTL 1] Japanese Patent Laid-Open No. 2006-44112
[PTL 2] Japanese Patent Laid-Open No. Hei 5-69545

SUMMARY OF INVENTION

Technical Problem

A nozzle of an inkjet head ejects an ink droplet having volume corresponding to resolution of printing. In recent years, resolution of printing by an inkjet printer has become higher and an ink droplet ejected from the nozzle is, for example, a small droplet whose volume is not more than several pl (for example, 3 pl to 5 pl). Therefore, in order to eject an ink droplet having an appropriate size and volume from a nozzle, the nozzle is required to be formed with an extremely high degree of accuracy.

However, it is difficult that ejection characteristics of all nozzles are completely controlled. Further, a nozzle having a normal ejection characteristic at the time of being manufactured may occur variation of the ejection characteristic after the inkjet printer has been used. Therefore, for example, even when some nozzles are provided with different ejection characteristics, the inkjet printer is required to perform printing appropriately.

On the other hand, for example, in a conventional inkjet printer having a high image quality, variation of an ejection characteristic of a nozzle is averaged by a multi-scan printing system in which one line formed by scanning in a main scanning direction of an inkjet head is printed by using a plurality of nozzles, thereby the image quality is improved. The multi-scan printing system is, for example, a method in which scanning of the inkjet head for one line is performed plural times to perform printing of the one line. Further, the inkjet head is relatively moved in a sub-scanning direction with respect to a medium while plural times of scanning are performed so that another nozzle different from the nozzle used in the preceding scanning is superposed on the line.

However, for example, in an inkjet printer and the like for performing high-speed printing, instead of printing by utilizing a multi-scan printing system, printing may be performed by a single-scan (1 scan) printing system in which a medium is relatively passed under the inkjet head only once and one line is printed by one nozzle. In this case, one line is printed by one nozzle and thus variation of the ejection characteristic of the nozzle directly affects a printed result. Further, as a result, striped variation extending in the moving direction of the inkjet head may occur. Therefore, conventionally, it is required that a problem such as striped variation occurred as described above is reduced to improve the image quality of a printed result.

In view of the problem described above, an objective of the present invention is to provide an inkjet printer, a printing method, a manufacturing method for a printed product and a printed product, which are capable of solving the problem.

We have searched prior arts relating to the present invention and we have found the above-mentioned Patent Literatures 1 and 2. However, the structures disclosed in the Patent Literatures are different from the present inventions in a correcting method and the like.

Solution to Problem

In order to attain the above-mentioned objectives, the present invention provides the following structures.

(Structure 1)

An inkjet printer in which an ink dot size that is a size of an ink dot formed on a medium by ejecting an ink droplet is modulated in plural levels to perform multi-gradation printing in an inkjet method, comprising:

an inkjet head including nozzles for ejecting the ink droplets and in which the ink droplets are ejected from the nozzle while relatively being moved in a line direction with respect to the medium; and an ejection control section which controls ejection of the ink droplets by the inkjet head by supplying an ejection control signal to the nozzle for controlling ejection of the ink droplets from the nozzle;

wherein the inkjet head forms lines of the dots in a direction perpendicular to the line direction in a juxtaposed manner in which the ink dots are juxtaposed in the line direction and, in each of the lines, the inkjet head forms the dots of the same color by ejecting the ink droplets from one of the nozzles corresponding to the line;

wherein, in a case that the ink droplets are to be ejected from the nozzle, the ejection control section supplies one of plural types of the ejection control signal respectively corresponding to each of the plural levels of the ink dot size to the nozzle, and the nozzle ejects the ink droplets depending on the ejection control signal which is received from the ejection control section, thereby the dot having the ink dot size corresponding to the ejection control signal is formed;

wherein the ejection control section changes control of ejection of the ink droplets depending on whether the nozzle for forming each of the lines is an abnormal nozzle, which is the nozzle in which an ejection error that is a difference between volume of the ink droplet ejected depending on the ejection control signal and a predetermined standard value is out of a predetermined permitted range, or a normal nozzle which is the nozzle in which the ejection error is within the permitted range;

wherein, in a case that the nozzle is the abnormal nozzle, the ejection control section supplies the ejection control signal corresponding to the ink dot size which is different from the ejection control signal supplied for the normal nozzle as the ejection control signal corresponding to a part of the dots juxtaposed in the line formed by the abnormal nozzle; and wherein the ejection control section supplies the ejection control signal which is different from the ejection control signal for the normal nozzle depending on the part of the dots in the line, thereby an average value in the line of the ejection errors is brought close to zero in comparison with a case that the ejection control signal which is the same ejection control signal for the normal nozzle is supplied as the ejection control signal corresponding to all the dots in the line.

The meaning of that "the ejection control signal which is different from the ejection control signal supplied for the normal nozzle is supplied as the ejection control signal corresponding to a part of the dots" is, for example, that "an ejection control signal which is the same as the ejection control signal for the normal nozzle is supplied as the ejection control signal corresponding to the remainder of the part of the dots in the line".

The inkjet printer is, for example, a printing apparatus which performs printing in a single-scan (1 scan) printing system. The plural levels of an ink dot size include, for example, the minimum ink dot size and integral multiples of the minimum ink dot size. The meaning of that "an ejection control signal is supplied to a nozzle" is, for example, that an ejection control signal is supplied to an element for ejecting ink such as a piezo element which is provided corresponding to the nozzle. The meaning of that "an average value of the ejection errors is brought close to zero" is, for example, that the absolute value of the average value is reduced. Further, the meaning of that "an average value of the ejection errors is brought close to zero" may be that the correction is executed so that the average value of the ejection errors becomes a value which is further close to zero. It is preferable that the average value of the ejection errors is less than 5% in the absolute value.

When a person looks ink dots formed on a medium, commonly, a large number of dots juxtaposed with a pitch corresponding to the resolution of printing are simultaneously observed instead of observing the dots individually. In this case, for example, as an impression of visual observation, an observer receives an impression which is averaged in a surrounding state of dots by a spatial frequency corresponding to a function of human eyesight instead of receiving an impression only from an individual dot.

Therefore, according to the above-mentioned structure, for example, an effect due to the abnormal nozzle is reduced in an impression of visual observation in comparison with a case that correction in which an average value of the ejection errors is brought close to zero is not executed. Further, as a result, for example, occurrence of striped variation or the like which is a problem in visual observation is restrained appropriately and image quality of a printed result can be enhanced appropriately.

Further, according to the above-mentioned structure, an operation for surrounding normal nozzles is not required to be changed in order to correct an ejection characteristic of the abnormal nozzle. Therefore, according to the above-mentioned structure, for example, correction of an ejection characteristic of the abnormal nozzle is executed appropriately without occurring effect on a portion printed by a normal nozzle. Further, for example, correction is easily executed in comparison with a case that an operation of the surrounding normal nozzles is also changed.

Further, according to the above-mentioned structure, an ejecting amount from the abnormal nozzle can be approximately changed by utilizing a gradation control function (half tone reproduction capability) of the inkjet head which is required for multi-gradation printing. Therefore, according to above-mentioned structure, for example, correction of the ejection characteristic of the abnormal nozzle can be easily and appropriately executed without adding a complicated function and structure in the inkjet printer.

Moreover, according to the above-mentioned structure, for example, since occurrence of a striped variation is restrained appropriately, even when printing is performed in a single-scan (1 scan) printing system, printing quality is appropriately enhanced to a high degree of image quality. Further, as a result, for example, a high degree of image quality and a high speed operation can be attained simultaneously. Moreover, since requirement for the variation of an ejection characteristic of the inkjet head can be relaxed, yield of the inkjet head which is to be used can be improved and reduction in cost can be attained appropriately.

In order to strictly execute correction of an ejection characteristic of the abnormal nozzle, it is conceivable that the number of liquid droplets of an ink droplet ejected from the abnormal nozzle is set with a high degree of accuracy so as to include a value after a decimal point, thereby the ejection error of each nozzle is set to be zero. (For example, in a case that 3-dots print is to be performed, it is conceivable that ink of 3.75 droplets is ejected from an abnormal nozzle which ejects a droplet having volume of 0.8 times in comparison with a normal nozzle ejecting a droplet depending on the same ejection control signal). However, when correction is to be executed by utilizing a gradation control function of the inkjet head (half tone reproduction capability), since the number of liquid droplets is limited to be changed only by the multiple of "1" and thus the above-mentioned change cannot be executed. Therefore, in order to execute the change, a complicated function and structure is required to be added to the inkjet printer.

On the other hand, according to the above-mentioned Structure 1, effect due to the abnormal nozzle can be reduced in an impression of visual observation by utilizing a gradation control function (half tone reproduction capability) of the inkjet head without setting the number of liquid droplets with a high degree of accuracy so as to include a value after a decimal point. Therefore, according to the above-mentioned Structure 1, as described above, correction of the ejection characteristic of the abnormal nozzle can be easily and appropriately executed without adding a complicated function and structure to the inkjet printer.

Further, for example, the inkjet head includes a nozzle row in which a plurality of nozzles is juxtaposed in a nozzle row direction which is perpendicular to the line direction and a dot line is formed in the nozzle row direction in a juxtaposed manner. According to this structure, for example, a plurality of lines is printed simultaneously while appropriately restraining occurrence of a striped variation or the like. Further, as a result, for example, printing with a high degree of quality can be performed at a high speed.

For example, the ejection control section executes the correction so that an average value of the ejection errors is within a predetermined range by making the average value of the ejection errors bring close to zero. For example, the ejection control section executes the correction so that the absolute value of the average value of the ejection errors becomes the minimum.

Further, the ejection control section may calculate an average value of each of plural levels of an ink dot size as the average value of the ejection errors. In this case, for example, the ejection control section makes an average value of the ejection errors corresponding to each of the ink dot sizes bring close to zero. Further, for example, the ejection control section may select a region where dots having the same ink dot size are successively juxtaposed each other by a predetermined number or more and the correction is executed for the region. According to this structure, correction is appropriately executed to a portion where a striped variation is easily conspicuous while restraining a processing amount for the total correction.

Further, the inkjet printer may, for example, perform printing by using plural colors of ink (for example, inks of colors "Y", "M", "C" and "K"). In this case, the inkjet printer includes, for example, inkjet heads respectively corresponding to the respective colors of a plurality of inks. In this case, for example, the above-mentioned correction for the abnormal nozzle is executed for each color. Further, in this case, the meaning of that "in each of the dot lines, the inkjet head forms the dots having the same color by ejecting the ink droplets from one of the nozzles corresponding to the line" is, for example, that one nozzle of the inkjet heads of the respective colors is corresponded to one line. In this case, when focusing on only the dots of one of the colors in the line, the dots are formed only by one nozzle in the inkjet head of one of the colors.

(Structure 2)

In a case that the volume of the ink droplet ejected depending on the ejection control signal from the abnormal nozzle is larger than the standard amount, the ejection control section supplies the ejection control signal corresponding to an ink dot size smaller than the size in the normal nozzle as the ejection control signal corresponding to the part of the dots in the line, and in a case that the volume of the ink droplet ejected depending on the ejection control signal from the abnormal nozzle is smaller than the standard amount, the ejection control section supplies the ejection control signal corresponding to an ink dot size larger than the size in the normal nozzle as the ejection control signal corresponding to the part of the dots in the line. According to this structure, for example, an average value of the ejection errors is appropriately brought close to zero. Further, as a result, for example, correction of the ejection characteristic of the abnormal nozzle can be executed appropriately.

(Structure 3)

The ejection control section divides the line which is formed by the abnormal nozzle into a plurality of regions including a plurality of the dots, and an average value of the ejection errors in each of the regions is brought close to zero in comparison with a case that the ejection control signal which is the same ejection control signal as the normal nozzle is supplied.

Each of a plurality of the regions is, for example, a region including a predetermined number of dots which are successively juxtaposed each other in the line. The ejection control section may determine the number of the dots included in each region depending on the ejection characteristic of the abnormal nozzle. It is desirable that each of the regions includes, for example, about 11 dots or less (for example, 9 through 13 dots).

According to this structure, for example, a range for calculating the average value of the ejection errors can be appropriately matched to a spatial frequency in which a result of visual observation is easily averaged. Further, as a result, an effect due to the abnormal nozzle is further appropriately reduced in an impression when viewed visually.

(Structure 4)

A printing method in which an ink dot size that is a size of an ink dot formed on a medium by ejecting an ink droplet is modulated in plural levels to perform multi-gradation printing in an inkjet method, comprising:

using an inkjet head including nozzles for ejecting the ink droplet and in which ink droplets are ejected from the nozzle while relatively moving in a line direction with respect to the medium; and performing ejection control which controls ejection of the ink droplets by the inkjet head by supplying an ejection control signal to the nozzle for controlling ejection of the ink droplets from the nozzle;

wherein the inkjet head forms lines of the dots in a direction perpendicular to the line direction in a juxtaposed manner in which the ink dots are juxtaposed in the line direction and, in each of the lines, the inkjet head forms the dots having the same color by ejecting the ink droplets from one of the nozzles corresponding to the line;

wherein, in a case that the ink droplets are to be ejected from the nozzle in the ejection control, one of plural types of the ejection control signal respectively corresponding to each of the plural levels of the ink dot size is supplied to the nozzle, and the nozzle ejects the ink droplets depending on the ejection control signal which is received in the ejection control, thereby the dot having the ink dot size corresponding to the ejection control signal is formed;

wherein, in the ejection control, control of ejection of the ink droplets is changed depending on whether the nozzle for forming each of the lines is an abnormal nozzle, which is the nozzle in which an ejection error that is a difference between volume of the ink droplet ejected depending on the ejection control signal and a predetermined standard value is out of a predetermined permitted range, or a normal nozzle which is the nozzle in which the ejection error is within the permitted range;

wherein, in a case that the nozzle is the abnormal nozzle, the ejection control signal corresponding to the ink dot size which is different from the ejection control signal supplied for the normal nozzle is supplied as the ejection control signal corresponding to a part of the dots juxtaposed each other in the line formed by the abnormal nozzle; and wherein the ejection control signal which is different from a case of the normal nozzle is supplied depending on the part of the dots in the line, thereby an average value in the line of the ejection errors is brought close to zero in comparison with a case that the ejection control signal which is the same ejection control signal as the normal nozzle is supplied as the ejection control signal corresponding to all the dots in the line. According to this method, for example, similar effects to the above-mentioned Structure 1 can be obtained.

(Structure 5)

A manufacturing method for a printed product in which an ink dot size that is a size of an ink dot formed on a medium by ejecting an ink droplet is modulated in plural levels to perform multi-gradation printing in an inkjet method to manufacture a printed product, comprising:

using an inkjet head including nozzles for ejecting the ink droplet and in which ink droplets are ejected from the nozzle while relatively moving in a line direction with respect to the medium; and performing ejection control which controls ejection of the ink droplets by the inkjet head by supplying an ejection control signal to the nozzle for controlling ejection of the ink droplets from the nozzle;

wherein the inkjet head forms lines of the dots in a direction perpendicular to the line direction in a juxtaposed manner in which the ink dots are juxtaposed in the line direction and, in each of the lines, the inkjet head forms the dots having the same color by ejecting the ink droplets from one of the nozzles corresponding to the line;

wherein, in a case that the ink droplets are to be ejected from the nozzle in the ejection control, one of plural types of the ejection control signal respectively corresponding to each of the plural levels of the ink dot size is supplied to the nozzle, and the nozzle ejects the ink droplets depending on the ejection control signal which is received in the ejection control, thereby the dot having the ink dot size corresponding to the ejection control signal is formed;

wherein, in the ejection control, control of ejection of the ink droplets is changed depending on whether the nozzle for forming each of the lines is an abnormal nozzle, which is the nozzle in which an ejection error that is a difference between volume of the ink droplet ejected depending on the ejection control signal and a predetermined standard value is out of a predetermined permitted range, or a normal nozzle which is the nozzle in which the ejection error is within the permitted range;

wherein, in a case that the nozzle is the abnormal nozzle, the ejection control signal corresponding to the ink dot size which is different from the ejection control signal supplied for the normal nozzle is supplied as the ejection control signal corresponding to a part of the dots juxtaposed in the line formed by the abnormal nozzle; and wherein the ejection control signal which is different from a case of the normal nozzle is supplied depending on the part of the dots in the line, thereby an average value in the line of the ejection errors is brought close to zero in comparison with a case that the ejection control signal which is the same ejection control signal as the normal nozzle is supplied as the ejection control signal corresponding to all the dots in the line. According to this method, for example, similar effects to the above-mentioned Structure 1 can be obtained.

(Structure 6)

An inkjet printer which performs multi-gradation printing in an inkjet method, comprising:

an inkjet head including nozzles for ejecting ink droplets; and an ejection control section which controls ejection of the ink droplets by the inkjet head;

wherein the ejection control section changes control for the ink droplets depending on a case of an abnormal nozzle in which an ejection error of volume of the ink droplet ejected from the nozzle is out of a predetermined permitted range or a case of a normal nozzle in which the ejection error is within the permitted range; and wherein, in a case that the nozzle is the abnormal nozzle, setting of an ink dot size of a part of dots in a line where ink dots formed by the abnormal nozzle are juxtaposed is changed from setting of an ink dot size which is formed when the nozzle is a normal nozzle, thereby an average value of errors of the ink dot sizes in the line is brought close to zero in comparison with a case that all dots are formed with the setting of the ink dot size which is the same as a case of the normal nozzle.

Also in this structure, similarly to the Structure 1, an effect due to the abnormal nozzle is appropriately reduced in an impression when viewed visually. Therefore, according to this structure, for example, similar effects to the above-mentioned Structure 1 can be obtained.

In the Structure 6, the meaning of that "setting of an ink dot size formed by the abnormal nozzle is changed" is, for example, that volume of an ink droplet ejected for forming a dot is changed by changing the ejection control signal supplied to the nozzle. An error of an ink dot size is, for example, an error occurred between a dot size formed by a normal nozzle whose ejection error is zero and a dot size of ink actually formed by the abnormal nozzle.

(Structure 7)

A printed product on which printing is performed in an inkjet method, comprising a plurality of lines in which plural ink dots formed by ink droplets ejected from a nozzle of an inkjet head are juxtaposed each other;

wherein the plurality of the lines comprises:

an abnormal nozzle line which is the line formed of ink droplets ejected from an abnormal nozzle that is a nozzle in which an ejection error of volume of an ejected ink droplet is out of a predetermined permitted range; and a normal nozzle line which is the line formed of ink droplets ejected from a normal nozzle that is a nozzle in which the ejection error is within the predetermined permitted range;

wherein, an ink dot size of a part of dots in the abnormal nozzle line is different from an ink dot size which is formed with the same setting as a case of the normal nozzle line, and an average value of errors of the ink dot sizes in the abnormal nozzle line is brought close to zero in comparison with a case that all dots are formed with setting of the ink dot size which is the same as a case of the normal nozzle line.

Also in this structure, similarly to the Structure 1, an effect due to the abnormal nozzle is appropriately reduced in an impression when viewed visually. Therefore, according to this structure, for example, similar effects to the above-mentioned Structure 1 can be obtained.

Advantageous Effects of Invention

According to the present invention, occurrence of a striped variation or the like is restrained appropriately and image quality of a printed result can be enhanced appropriately.

BRIEF DESCRIPTION OF DRAWINGS

FIG. 1(*a*) is a view showing an example of a structure of the printing system 10. FIG. 1(*b*) is a view showing an example of sizes of an ink dot formed on a medium 50 in the printing system 10.

FIG. 2(*a*) is a modeled view showing an example of lines of dots formed by one scanning operation. FIG. 2(*b*) is a view showing an example of lines formed when printing is performed in a multi-pass system.

FIG. 3(*a*) is a graph showing an example of an ejection characteristic of an abnormal nozzle. FIG. 3(*b*) is a view showing an example of printed result in a case that an abnormal nozzle is existed.

FIG. 4(*a*) is a modeled view showing an example of a result in which correction is performed on an abnormal nozzle whose volume of an ink droplet ejected depending on an ejection control signal is smaller than a standard amount. FIG. 4(*b*) is a modeled view showing an example of a result in which correction is performed on an abnormal nozzle whose volume of an ink droplet ejected depending on an ejection control signal is larger than the standard amount.

FIG. 5(*a*) is an enlarged view showing a line 306*f* in FIG. 4(*a*). FIG. 5(*b*) is an enlarged view showing a line 306*f* in FIG. 4(*b*).

DESCRIPTION OF EMBODIMENTS

Figure 1A:
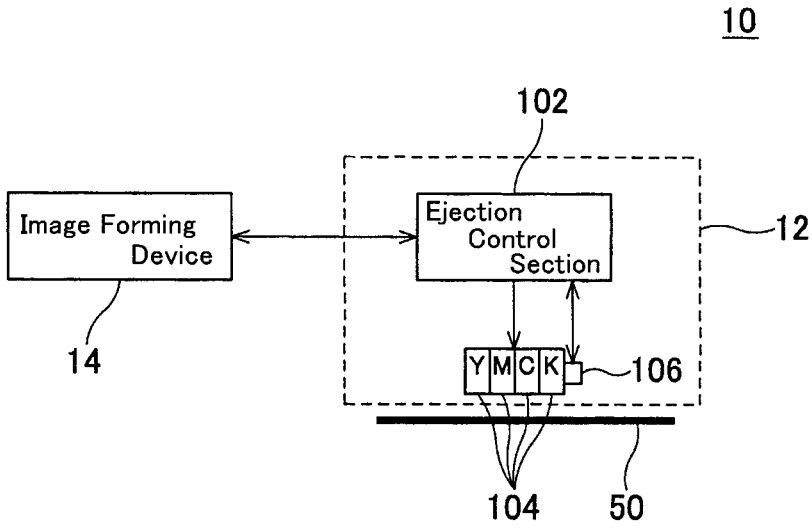
FIGS. 1(*a*) and 1(*b*) are views showing an example of a printing system 10 in accordance with an embodiment of the present invention.
Figure 1B:
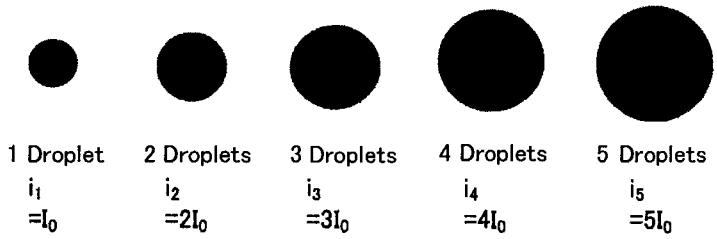

An embodiment of the present invention will be described below with reference to the accompanying drawings. FIGS. 1(*a*) and 1(*b*) are views showing an example of a printing system 10 in accordance with an embodiment of the present invention. FIG. 1(*a*) is a view showing an example of a structure of the printing system 10. FIG. 1(*b*) is a view showing an example of a size of a dot of ink (ink dot size) formed on a medium 50 in the printing system 10. The printing system 10 is a printing system for performing printing on a medium 50 in an inkjet method and includes an inkjet printer 12 and an image forming device 14. All or a part of a structure of the image forming device 14 which will be described below may be, for example, incorporated into the inkjet printer 12.

The inkjet printer 12 is a printing apparatus for performing printing according to printable data. Printable data are, for example, data representing an image which is to be printed by a format interpretable by the inkjet printer. Printable data may be, for example, data including an image formed by digital half-toning processing and commands for controlling an operation of the inkjet printer 12. The inkjet printer 12 receives printable data, for example, from the image forming device 14 and performs a printing operation according to the received printable data. Alternatively, instead of receiving from the image forming device 14, the inkjet printer 12 may create printable data on the basis of an image to be printed.

In this embodiment, the inkjet printer 12 includes an ejection control section 102, a plurality of inkjet heads 104 and a dot visual confirmation part 106. The ejection control section 102 is a control section by which ejection of an ink droplet from each of the inkjet heads 104 is controlled. An ejection control signal for controlling ejection of an ink droplet from a nozzle of the inkjet head 104 is supplied to each of the nozzles on the basis of the printable data received from the image forming device 14. The meaning of that an ejection control signal is supplied to a nozzle is, for example, that an ejection control signal is supplied to an element such as a piezo-element for ejecting ink provided so as to correspond to the nozzle.

When an ink droplet is to be ejected from a nozzle, the ejection control section 102 supplies an ejection control signal corresponding to either ink dot size among plural types of an ejection control signal corresponding to plural levels of an ink dot size, for example, as shown in FIG. 1(*b*) to a nozzle. In this manner, the ejection control section 102 makes each nozzle form an ink dot having an ink dot size corresponding to the supplied ejection control signal.

In addition, in this embodiment, the ejection control section 102 changes an ejection control signal applied at the time of forming a part of dots depending on whether a nozzle in the inkjet head 104 is an abnormal nozzle or a nozzle in the inkjet head 104 is a normal nozzle, thereby an ejection characteristic of the abnormal nozzle is corrected. In this case, for example, the ejection control section 102 supplies ejection control signals to respective nozzles on the basis of printable data and ejection control of an ink droplet which is different from a case for a normal nozzle is executed for the abnormal nozzle.

In this embodiment, an abnormal nozzle is, for example, a nozzle whose ejection error which is a difference between volume of an ink droplet ejected depending on an ejection control signal and a predetermined standard value is out of a permitted range. Further, a normal nozzle is a nozzle whose ejection error is within the permitted range. Correction of the ejection characteristic of the abnormal nozzle will be described in detail below.

Each of a plurality of the inkjet heads 104 is an inkjet head for ejecting ink of a different color. In this embodiment, the respective inkjet heads 104 are provided so as to correspond to respective colors of "Y", "M", "C" and "K" inks. Further, each of the inkjet heads 104 is provided with a nozzle row in which a plurality of nozzles are juxtaposed each other in a predetermined nozzle row direction. Ink droplets of a color corresponding to the inkjet head 104 are ejected from respective nozzles in the nozzle row depending on an ejection control signal received from the ejection control section 102. Further, each of the inkjet heads 104 ejects ink droplets to respective positions on a medium 50 by a scanning operation for ejecting ink droplets while relatively moving in a direction perpendicular to the nozzle row (hereinafter, referred to as a line direction) with respect to the medium 50.

Further, each of the nozzles of the inkjet head 104 ejects an ink droplet depending on an ejection control signal received from the ejection control section 102 and forms an ink dot having a size corresponding to the ejection control signal. In each nozzle, for example, the number of liquid droplets of the ink droplet which are ejected and reached to the same portion on the medium 50 is changed in "n" levels ("n" is a predetermined integer), thereby the size of an ink dot is changed. For example, in a case that an ejecting amount of ink at the time of one ejection is set to be "Io", as shown in FIG. 1(*b*) which represents a case of "n=5", each nozzle changes the number of ink droplets (number of liquid droplets) which are ejected and reached to the same portion from one droplet to five droplets. In this manner, each nozzle increases a total amount of volume of ink (hereinafter, referred to as ink volume) ejected to the same portion as "Io", "2Io", "3Io", "4Io" and "5Io" in this order to form a dot having a size corresponding to the ink volume. Further, the inkjet printer 12 performs multi-gradation printing by modulating an ink dot size to plural levels.

In this embodiment, the inkjet printer 12 is, for example, a printing apparatus for performing printing in a single-scan (one scan) printing system. In this case, the inkjet head 104 of each color passes each position on a medium in only one scanning operation. In this manner, the inkjet head 104 of each color forms lines of ink dots which are juxtaposed in the line direction so as to be juxtaposed in the nozzle row direction which is perpendicular to the line direction. Further, in a line of respective dots, the dots of the same color are formed by ejection of ink droplets from one nozzle which is corresponded to the line in the inkjet head 104 corresponding to the color.

Further, the inkjet printer 12 performs printing in a multi-pass system in which, for example, a scanning operation for moving the inkjet head 104 in a main scan direction which is parallel to the line direction and a medium feeding operation for relatively moving the inkjet head 104 with respect to the medium 50 in a sub-scanning direction which is parallel to the nozzle row direction are repeated over the entire medium 50. In this case, in the respective medium feeding operations, the inkjet printer 12 moves the inkjet head 104 in the sub-scanning direction, for example, by a length of the nozzle row.

Further, the inkjet printer 12 may perform printing over the entire medium 50 by one scanning operation in a single pass system. In this case, a full line type inkjet head may be used as each of the inkjet heads 104.

The dot visual confirmation part 106 is, for example, an imaging device such as a CCD image sensor, which image-pickups ink dots formed on a medium 50 or a line formed by juxtaposed dots. In this manner, the dot visual confirmation part 106 acquires an image which is used to measure an ink dot size, a line width of a line (print line width) or a density value (print density value). Further, in this embodiment, the dot visual confirmation part 106 transmits an image which has been image-pickuped to the image forming device 14 through the ejection control section 102.

The image forming device 14 is, for example, a computer which operates depending on a predetermined program and, for example, forms printable data through image processing such as an "RIP" processing. Further, the image forming device 14 executes digital half-toning processing and the like in the image processing, for example, in accordance with a structure of the inkjet head of the inkjet printer.

In addition, in this embodiment, the image forming device 14 manages nozzle information representing an ejection characteristic of an abnormal nozzle in the respective inkjet heads 104. Printable data are formed on the basis of the nozzle information, thereby printable data are formed through which the inkjet printer 12 executes correction corresponding to the ejection characteristic of the abnormal nozzle. The nozzle information includes, for example, information representing a position of the abnormal nozzle in the nozzle row, an ejecting amount of the abnormal nozzle and the like as the ejection characteristic of the abnormal nozzle. Information representing an ejecting amount of the abnormal nozzle may be, for example, information representing a difference between an ejecting amount of the abnormal nozzle and a standard amount.

Further, the image forming device 14 creates and changes nozzle information on the basis of an image having been image-pickuped by the dot visual confirmation part 106. Therefore, for example, when an abnormal nozzle is newly occurred, the image forming device 14 creates new nozzle information representing an ejection characteristic of the abnormal nozzle.

When correction of an ejection characteristic of a nozzle which will be described below is to be executed, ink volume of an ink droplet ejected from each of the nozzles is required to be accurately obtained with a necessary degree of accuracy. In this case, for example, when adjustment is to be performed in a factory or the like before shipment of an inkjet printer 12, ink volume from each of the nozzles is easily obtained on the basis of a ratio of an ejection number of ink droplets from each nozzle and a decreased amount of the ink.

However, in a case that ejection abnormality is occurred in use by a user or the like after starting use of the inkjet printer 12, it is not easy to directly obtain ink volume from each nozzle. Therefore, in this embodiment, instead of directly obtaining ink volume as described above, for example, a parameter corresponding to ink volume is calculated on the basis of an image which is image-pickuped by the dot visual confirmation part 106. For example, the image forming device 14 calculates a parameter corresponding to ink volume on the basis of a relationship having been previously measured relating to a change of a formed ink dot size with respect to the number of ejected liquid droplets, a change of a line width for each nozzle with respect to the number of ejected liquid droplets, or a change of average density with respect to the number of ejected liquid droplets, and a measured value calculated by using the image which is image-pickuped by the dot visual confirmation part 106. Further, the nozzle information is created or updated on the basis of the parameter and printable data are formed on the basis of the nozzle information and, in this manner, the image forming device 14 makes the inkjet printer 12 execute correction of an ejection characteristic of the abnormal nozzle.

Figure 2A:
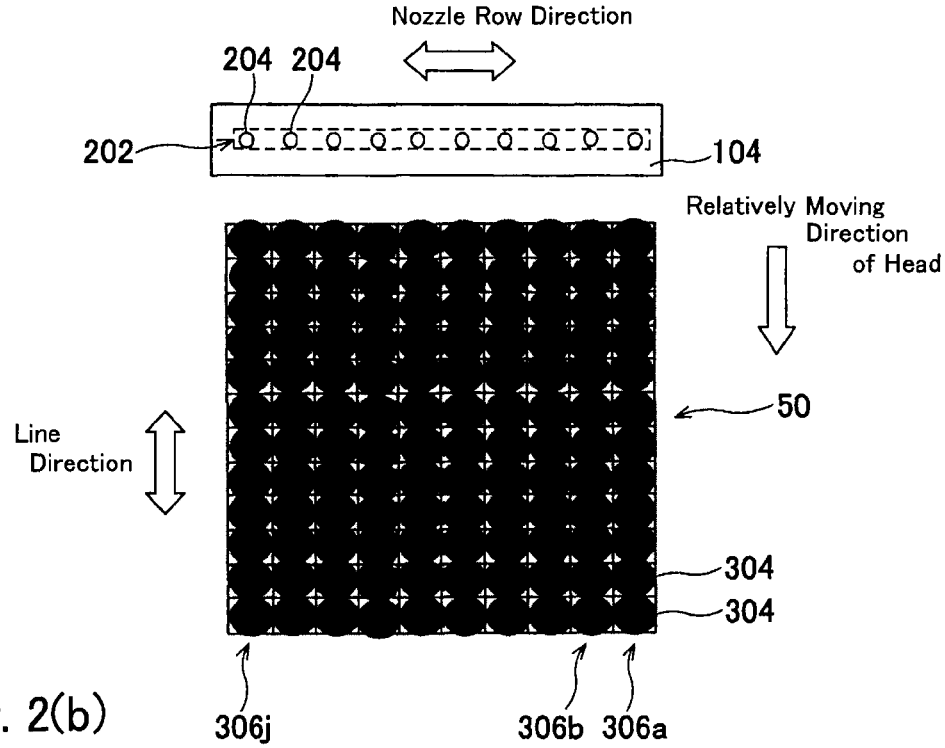
FIGS. 2(*a*) and 2(*b*) are views showing an example of a state of dots of ink formed by an inkjet head 104.
Figure 2B:
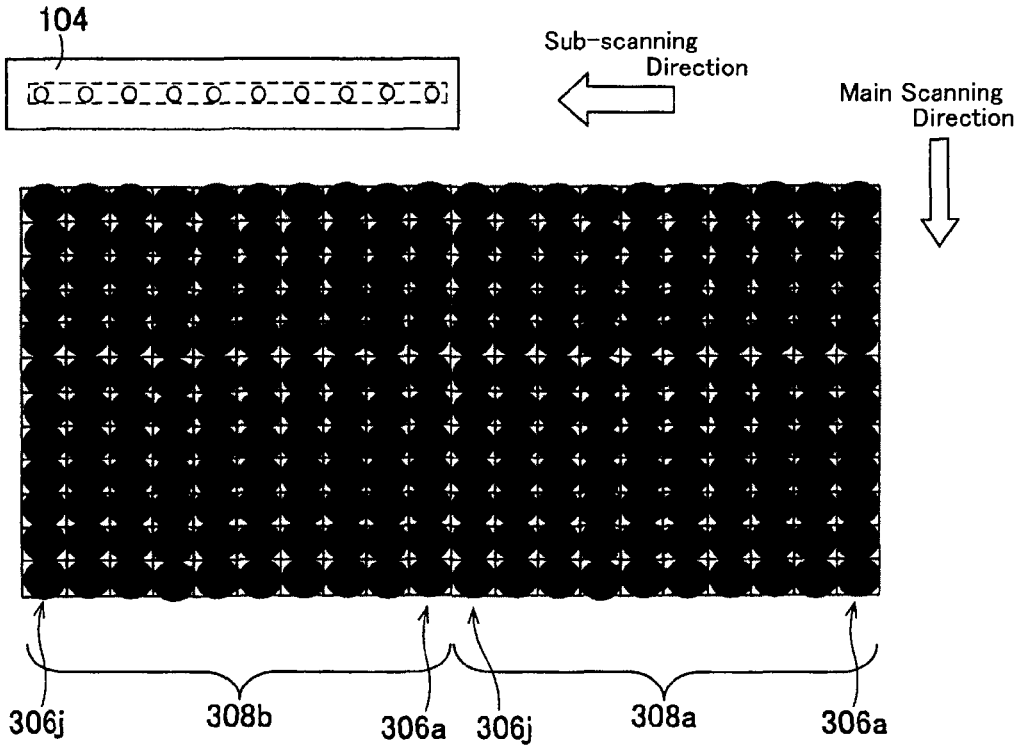

FIGS. 2(*a*) and 2(*b*) are views showing an example of a state of dots of ink formed by the inkjet head 104. FIG. 2(*a*) is a modeled view showing an example of lines of dots formed by one scanning operation and an example of lines which are formed by an inkjet head 104 for one color of a plurality of the inkjet heads 104 corresponding to respective colors of "Y", "M", "C" and "K" inks. FIG. 2(*a*) shows a state that no abnormal nozzle is existed and all dots 304 with the same size are formed.

In this embodiment, the inkjet head 104 is provided with a nozzle row 202 in which a plurality of the nozzles 204 is juxtaposed each other in the nozzle row direction. Ink droplets are ejected from the respective nozzles 204 while being relatively moved with respect to a medium 50 to form lines 306*a* through 306*j* corresponding to a plurality of the nozzles 204 in the nozzle row 202. In each of the lines 306*a* through 306*j*, dots 304 of ink are juxtaposed each other in the line direction which is perpendicular to the nozzle row direction. In this manner, the inkjet head 104 forms each of a plurality of the lines 306*a* through 306*j* by using one nozzle 204 corresponding to each line in the nozzle row 202.

FIG. 2(*b*) is a view showing an example of lines formed when printing is performed in a multi-pass system. In this case, the inkjet printer 12 performs printing by repeating a scanning operation in the main scan direction and a medium feeding operation in the sub-scanning direction. Further, in respective scanning operations, the inkjet head 104 forms line groups 308*a* and 308*b* comprised of a plurality of the lines 306*a* through 306*j* corresponding to a plurality of the nozzles 204 of the nozzle row 202. Also in this case, in the respective line groups 308*a* and 308*b*, the inkjet head 104 forms each of a plurality of the lines 306*a* through 306*j* by using one nozzle 204 corresponding to each line in the nozzle row 202.

Figure 3A:
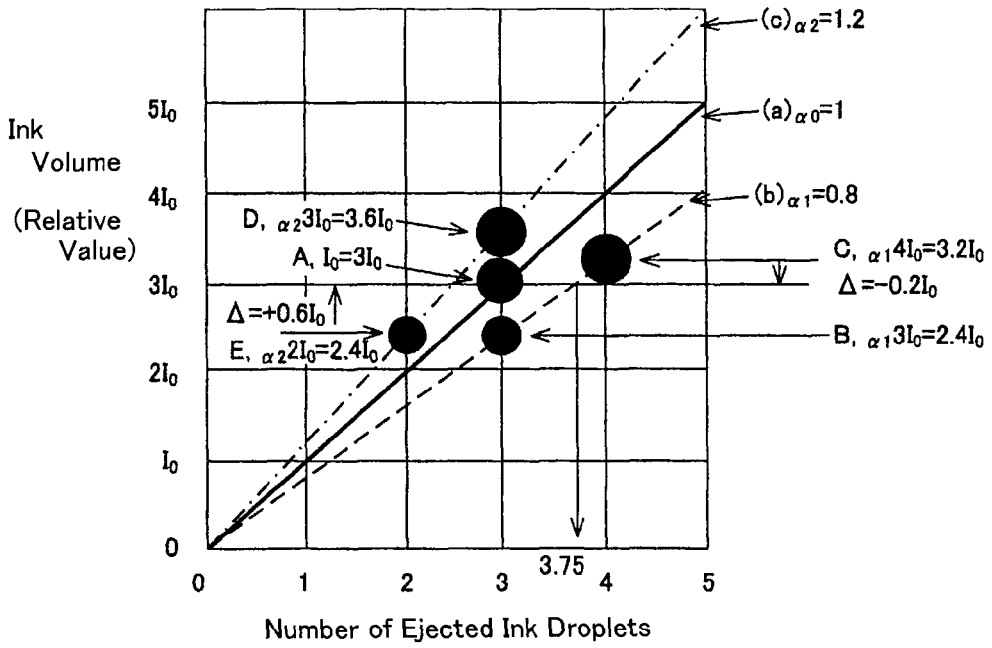
FIGS. 3(*a*) and 3(*b*) are views for explaining effects of an abnormal nozzle.
Figure 3B:
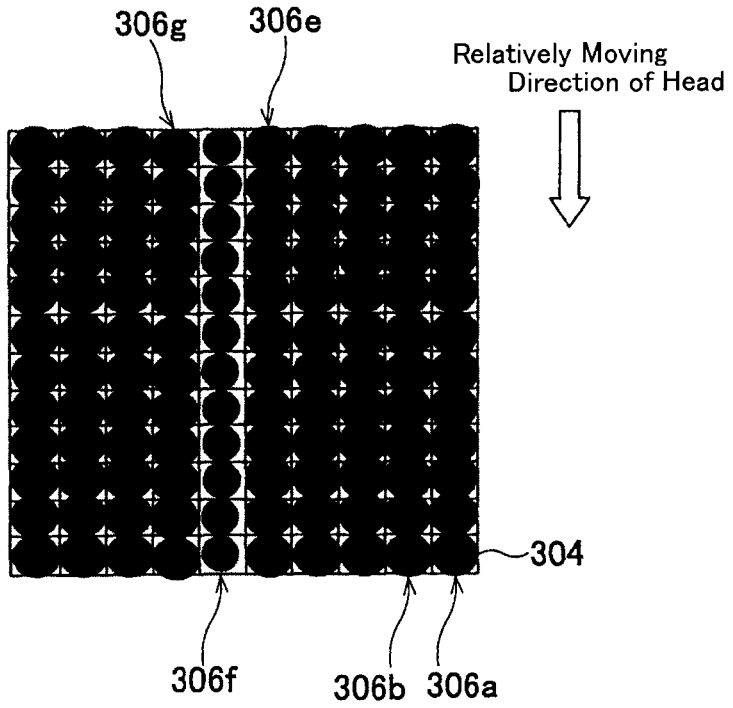

FIGS. 3(*a*) and 3(*b*) are views for explaining effects of an abnormal nozzle. FIG. 3(*a*) is a graph showing an example of an ejection characteristic of an abnormal nozzle and shows an example of a relationship between the number of liquid droplets (horizontal scale) of ink droplet which is ejected to the same portion and ink volume (vertical scale). In the graph, the solid line (a) shows a relationship in a case of a normal nozzle.

When ink volume is changed with the number of liquid droplets like this embodiment, the ink volume is proportional to the number of liquid droplets. Further, when the "To" is considered as a unit for the ink volume, the coefficient "αo" of proportion is 1 (one) in a normal nozzle. In this case, for example, as shown at the point "A" in the graph, when the number of liquid droplets is set to be 3 (hereinafter, referred to as 3-dots print), the ink volume is "3To".

Further, in the graph, the broken line (b) and the alternate long and short dash line (c) respectively show examples of a relationship between the number of liquid droplets and ink volume in an abnormal nozzle. A nozzle having an ejection characteristic shown by the broken line (b) is an abnormal nozzle whose volume of an ink droplet ejected depending on an ejection control signal is smaller than the standard amount and its volume is reduced by "α1" times (α1<1) in comparison with a normal nozzle ejecting an ink droplet having the standard amount. For example, in a case shown in the graph, "α1"=0.8. In this case, the coefficient of proportion is 0.8 and the ink volume corresponding to each of the respective numbers of liquid droplets becomes 80% in comparison with a normal nozzle. In this case, the ink volume of 3-dots print is, as shown at the "B" point in the graph, "2.4 To", i.e., 80% in comparison with a normal nozzle and is decreased by "0.6Io" in comparison with a normal nozzle.

On the contrary, a nozzle having an ejection characteristic shown by the alternate long and short dash line (c) is an abnormal nozzle whose volume of an ink droplet ejected depending on an ejection control signal is larger than the standard amount and its volume is increased by "α2" times (α2>1) in comparison with a normal nozzle ejecting an ink droplet having the standard amount. For example, in a case shown in the graph, "α2"=1.2. In this case, the coefficient of proportion is 1.2 and the ink volume corresponding to each of the respective numbers of liquid droplets becomes 120% in comparison with a normal nozzle. In this case, the ink volume of 3-dots print is "3.6 Io", i.e., 120% as shown at the point "D"

in the graph in comparison with a normal nozzle and is increased by "0.6Io" in comparison with a normal nozzle.

FIG. 3(*b*) is a view showing an example of a printed result in a case that an abnormal nozzle is existed and shows a printed result in which correction of an ejection characteristic of the abnormal nozzle is not executed in a case that the abnormal nozzle having an ejection characteristic corresponding to the broken line (b) is existed. Further, FIG. 3(*b*) shows, similarly to FIG. 2(*a*), a state in which all dots 304 are to be formed so as to have the same size.

For example, in a case that the above-mentioned abnormal nozzle is existed in the nozzle row at a position corresponding to the line 306*f* in the drawing, the dot 304 formed by the abnormal nozzle becomes smaller than the dot 304 formed by another nozzle. As a result, the line 306*f* which is formed by the abnormal nozzle becomes narrower than another lines 306*a*, 306*b* and the like. Therefore, in the printed result, for example, the line 306*f* is separated from the both lines 306*e* and 306*g* adjacent to each other and striped variation (white stripe) occurs in a relatively moving direction of the inkjet head 104 with respect to the medium 50. Further, as a result, for example, when printing is performed in one scan system, the image quality may be largely lowered.

In order to prevent this problem, for example, when the abnormal nozzle is to be used by which a dot 304 is formed to be smaller, it is conceivable that the number of liquid droplets is increased in comparison with that of a normal nozzle for forming the dot 304. However, in this case, for example, when the number of liquid droplets by the abnormal nozzle is simply increased to 4 for forming the dot 304 which is to be formed with 3-dots print by a normal nozzle, the ink volume is increased to "3.2 Io" as shown at the point "C" in the graph. Therefore, when such a change is executed, the ink volume exceeds by "0.2 Io" with respect to the value formed by a normal nozzle, thereby the density is increased. As a result, even when the white stripes are eliminated, malfunction may occur in which black striped variation (black stripe) is visible. Therefore, it is difficult that the ejection characteristic of the abnormal nozzle is corrected by such a simple change.

Although not shown in the drawing, when an abnormal nozzle having an ejection characteristic corresponding to the alternate long and short dash line (c) is existed, similar problem may occur. In this case, when correction of the ejection characteristic of the abnormal nozzle is not executed, the line 306 formed by the abnormal nozzle becomes wider to occur black stripes. Further, in this case, for example, when the number of liquid droplets by the abnormal nozzle is simply decreased to 2 for forming the dot 304 which is to be formed with 3-dots print by a normal nozzle, the ink volume is decreased to "2.4 Io" as shown at the point "E" in the graph. Therefore, when such a change is executed, the ink volume is decreased less by "0.6 Io" with respect to the value by a normal nozzle. As a result, even when the black stripes are eliminated, malfunction may occur in which white stripes are newly visible.

On the other hand, in this embodiment, the number of liquid droplets ejected from the abnormal nozzle is not simply changed. In this embodiment, the number of liquid droplets is changed only at the time of forming a part of dots 304 so that an average ink volume in the line 306 is adjusted. The correction method will be described in detail below.

In this embodiment, the ejection control section 102 changes ejection control of ink droplets depending on whether a nozzle forming each line is an abnormal nozzle or a normal nozzle. For example, in a case that a nozzle is an abnormal nozzle, the ejection control section 102 supplies an ejection control signal corresponding to an ink dot size which is different from an ejection control signal supplied for a normal nozzle as an ejection control signal corresponding to a part of dots in a plurality of dots juxtaposed in the line which are formed by the abnormal nozzle.

More specifically, for example, when volume of an ink droplet which is ejected from an abnormal nozzle depending on an ejection control signal is larger than a standard amount, the ejection control section 102 supplies an ejection control signal corresponding to a smaller ink dot size in comparison with the size of the normal nozzle as an ejection control signal corresponding to a part of dots in the line. Alternatively, when volume of an ink droplet which is ejected from an abnormal nozzle depending on an ejection control signal is smaller than the standard amount, the ejection control section 102 supplies an ejection control signal corresponding to a larger ink dot size in comparison with the size of the normal nozzle as an ejection control signal corresponding to a part of dots in the line.

In this manner, the ejection control section 102 makes an average value of ejection errors in the line bring close to zero in comparison with a case that the same ejection control signal as that for a normal nozzle is supplied as an ejection control signal corresponding to all dots in the line. The meaning of that "the average value of ejection errors is brought close to zero" is, for example, that the absolute value of the average value is reduced. The ejection control section 102 executes the correction so that, for example, an average value of the ejection errors is set within a predetermined range by making the average value of the ejection errors bring close to zero. It is preferable that the ejection control section 102 executes the correction so that, for example, the absolute value of the average value of the ejection errors is set to be the minimum.

According to this embodiment, for example, in comparison with a case that the correction is not executed, an effect due to the abnormal nozzle is reduced in an impression when viewed visually. Further, according to this embodiment, for example, occurrence of striped variation which is a problem when viewed visually can be restrained appropriately.

Further, in this embodiment, the ejection control section 102 divides the line which is formed by the abnormal nozzle into a plurality of regions each of which includes a plurality of dots and makes an average value of the ejection errors in each region bring close to zero in comparison with a case that the same ejection control signal as that for a normal nozzle is supplied. Each of a plurality of the regions is, for example, a region including a predetermined number of dots which are successively juxtaposed each other in the line. It is desirable that each of the regions includes, for example, about 11 dots (for example, 9 through 13 dots) or less.

When the average value of each divided region is considered, for example, a range for calculating the average value of the ejection errors can be appropriately matched to a spatial frequency in which a result of visual observation is easily averaged. Further, as a result, an effect due to the abnormal nozzle is further appropriately reduced in an impression when viewed visually.

In addition, when occurrence of a striped variation is restrained appropriately, for example, even when printing is performed in a single-scan (1 scan) printing system, printing quality is appropriately enhanced to a high degree of image quality. Therefore, in this embodiment, for example, a high degree of image quality and a high speed operation can be attained simultaneously. Moreover, since requirement for variation of an ejection characteristic of the inkjet head can be relaxed, yield of the inkjet head which is to be used can be improved and reduction in cost can be attained appropriately.

Figure 4A:
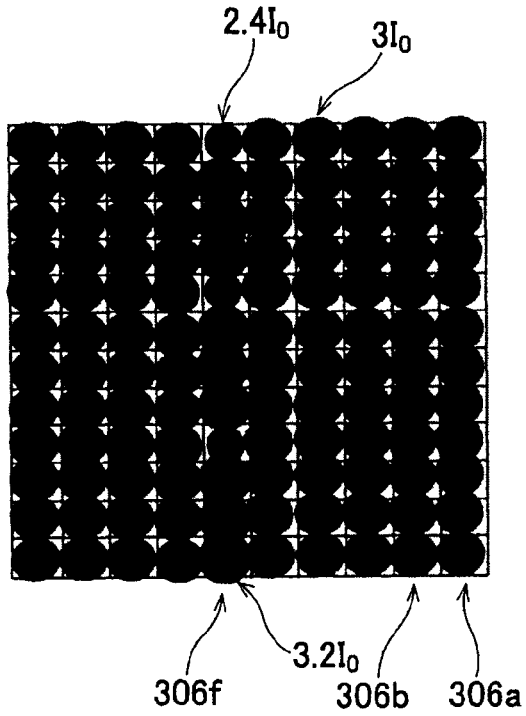
FIGS. 4(*a*) and 4(*b*) are views showing an example of a printed result when an ejection characteristic of an abnormal nozzle is corrected.
Figure 4B:
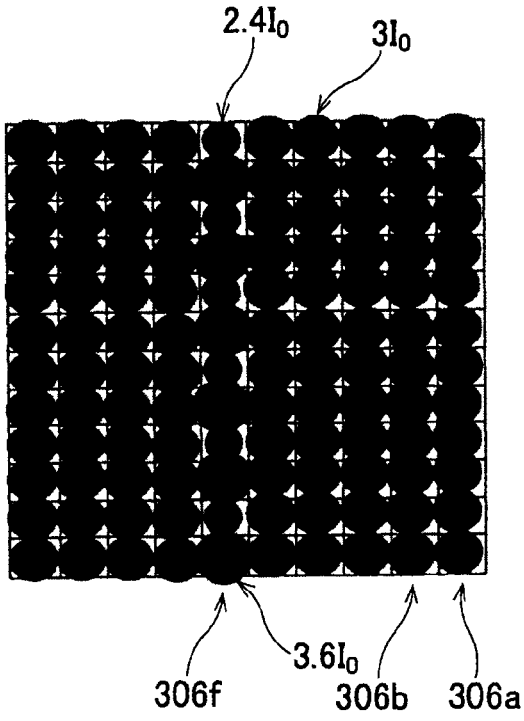
Figure 5A:
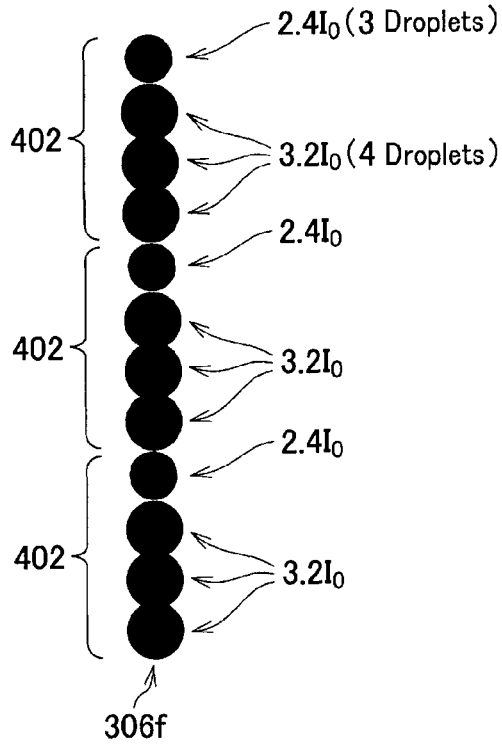
FIGS. 5(*a*) and 5(*b*) are enlarged views showing a line 306*f* corresponding to an abnormal nozzle.
Figure 5B:
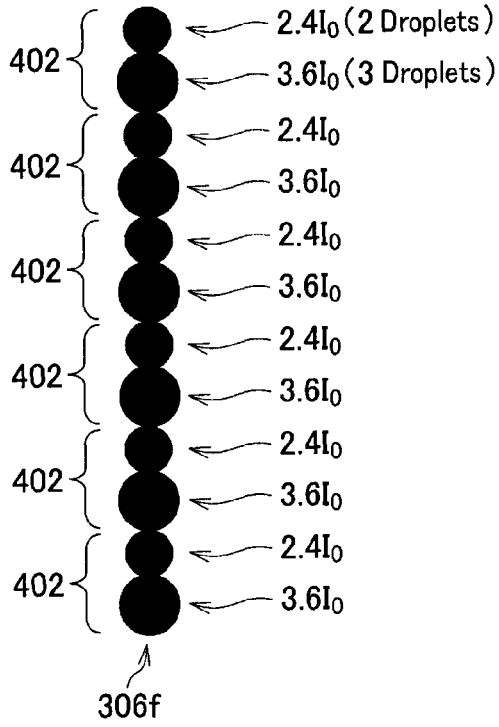

FIGS. 4(*a*) and 4(*b*) and FIGS. 5(*a*) and 5(*b*) are views showing an example of a printed result when the ejection characteristic of the abnormal nozzle is corrected. FIG. 4(*a*) is a modeled view showing an example of a result in which correction is performed on the abnormal nozzle whose volume of an ink droplet ejected depending on an ejection control signal is smaller than a standard amount and FIG. 4(*a*) shows an example of a result in which the abnormal nozzle corresponding to the broken line (b) in the graph of FIG. 3(*a*) is existed. Further, FIG. 5(*a*) is an enlarged view showing the line 306*f* in FIG. 4(*a*).

For example, in a case that a nozzle for forming the line 306*f* is an abnormal nozzle, when all dots are printed with 3-dots print without correcting the ejection characteristic of the abnormal nozzle, as shown in FIG. 3(*b*), white stripes are occurred on both sides of the line 306*f*. On the other hand, in order to set the ink volume of the abnormal nozzle to be "3 Io" which is the same as a normal nozzle, the number of liquid droplets of ink droplet which is ejected from the abnormal nozzle is required to be 3.75. However, since the number of liquid droplets is limited to be changed only by the multiple of "1" and thus the above-mentioned change cannot be executed.

Therefore, in this embodiment, an average of ejection errors in a region having a predetermined length which is formed by dividing a line is brought close to zero, thereby the ink volume is averaged and a density difference is minimized between a line which is formed by a normal nozzle and a line formed by the abnormal nozzle. As a result, occurrence of a striped variation can be restrained appropriately. A method of the correction will be specifically described below.

For example, when ink volume of 1 droplet is set as "Io" for a normal nozzle and as "io" for an abnormal nozzle and the "io" is set as "io=αIo", an ink volume difference "Δ1" of one (1) droplets between the normal nozzle and the abnormal nozzle is expressed as the following expression (1).

$$\Delta 1 = io - Io = (\alpha - 1)Io \qquad \text{Expression (1)}$$

$$\text{wherein "}io = \alpha Io\text{"} \qquad \text{Expression (2)}$$

Further, an ink volume difference "Δ3" of 3 droplets between the normal nozzle and the abnormal nozzle is expressed as the following expression (3).

$$\Delta 3 = 3\Delta 1 = 3(\alpha - 1)Io \qquad \text{Expression (3)}$$

In this case, when an ejecting amount is increased by one droplet to be four droplets for compensating shortage of ink volume from the abnormal nozzle, an ejecting amount "i4" and an ink volume difference "Δ4" between the normal nozzle and the abnormal nozzle in this case are respectively expressed as the following expressions.

$$i4 = 4io = 4\alpha Io \qquad \text{Expression (4)}$$

$$\Delta 4 = 4io - 3Io = (4\alpha - 3)Io \qquad \text{Expression (5)}$$

In order to make an average value of ejection errors bring close to zero, a condition is required to obtain in which a shortage amount of the ink volume represented by the expression (3) and an increased amount of the ink volume represented by the expression (5) become as equal as possible. More specifically, for example, when a density difference which is occurred by "M" pieces of a dot ("M" dots) formed by ejecting three droplets from an abnormal nozzle with respect to a normal nozzle and a density difference which is occurred by "N" pieces of a dot ("N" dots) formed by ejecting four droplets from the abnormal nozzle with respect to the normal nozzle are equal to each other in a reverse direction, the following expressions are obtained from the expressions (3) and (5).

$$3M(\alpha - 1)Io = -N(4\alpha - 3)Io \qquad \text{Expression (6)}$$

$$3M(1 - \alpha) = N(4\alpha - 3) \qquad \text{Expression (7)}$$

In the abnormal nozzle in this embodiment, $\alpha = \alpha 1 = 0.8$ and thus, when this relation is substituted, $$0.6M = 0.2N$$

$$N/M = 3 \qquad \text{Expression (8)}$$

In this case, from the expression (8), "N"=3 pieces of a dot which is formed by an abnormal nozzle with 4 droplets whose number of liquid droplets is increased are formed per one dot, i.e., "M"=1 piece of a dot which is formed with 3 droplets by the abnormal nozzle. As a result, an average of differences of ink volume which is compared with the case of a normal nozzle becomes plus and minus zero (±0), in other words, an average of the ejection errors becomes zero. In this case, in the line formed by the abnormal nozzle, when a volume increased dot whose number of liquid droplets is increased to 4 droplets is formed depending on an ejection control signal different from that for a normal nozzle at a rate of three dots for one dot which is formed with 3 droplets depending on the same ejection control signal as that for a normal nozzle, average ink volume becomes equivalent to the line which is formed by the normal nozzle with all dots having 3 droplets. Therefore, an averaged result is observed when viewed visually and striped variation is hard to be observed in a printed result.

For example, in a modeled case as shown in FIG. 4(*a*), as shown in FIG. 5(*a*) which is an enlarged view, in the line 306*f* which is a line formed of ink droplets ejected from the abnormal nozzle (abnormal nozzle line), correction of the ejection characteristic of the abnormal nozzle is executed in a region 402 including four successive dots formed by the abnormal nozzle as a unit in which three pieces of a corrected dot whose ink volume is "3.2Io" (4 droplets) are corresponded to one piece of a dot whose ink volume is "2.4Io" (3 droplets). When the correction is executed in which the ink volume is set to be equivalent, as shown in the drawing, a white line (white stripe) occurred in the relative displacement direction of the inkjet head becomes inconspicuous in a printed product, for example, in comparison with a case shown in FIG. 3(*b*).

In the example of "α1"=0.8, the "N" and "M" become an integer but generally the "N" and "M" may not become an integral value. Therefore, in this case, for example, as described below, integer values of "N" and "M" are obtained in a range that a shortage amount of ink volume in a state where the number of liquid droplets is not increased and an increased amount of ink volume in a state where the number of liquid droplets is increased are set within a predetermined value.

For example, as shown by the following expression (9) which is obtained from the expression (7), appropriate "N" and "M" are obtained by adjusting a difference between the both ink volumes less than 5% at the absolute value of "Io", whereby the striped variation is hard to be observed when viewed visually.

$$|\{3M(1 - \alpha) - N(4\alpha - 3)\}| \times Io \leq 0.05Io \qquad \text{Expression (9)}$$

When the "N" and "M" values become too large, averaging by visual observation may be difficult. Therefore, it is preferable that a total value (M+N) of "N" and "M" does not exceed 11. Further, the most ideally, it is preferable that a density difference of the expression (6) becomes zero.

Next, another example relating to the correction will be described below. FIG. 4(*b*) is a modeled view showing an example of a result in which correction is performed on an abnormal nozzle whose volume of an ink droplet ejected depending on an ejection control signal is larger than a standard amount. FIG. 4(*b*) shows an example of a result in a case that an abnormal nozzle corresponding to the alternate long and short dash line (c) in the graph of FIG. 3(*a*). Further, FIG. 5(*b*) is an enlarged view showing the line 306*f* in FIG. 4(*b*).

When 3-dots print is to be performed, in order to set the ink volume of the abnormal nozzle to be normal "3 Io", the ink volume is decreased by "0.6Io" per one abnormal dot. In this case, "$\alpha=\alpha 2$" is set in the expression (7) and, when a part of "M" pieces of a dot is set to be a volume reduced dot which is forming of 2 droplets instead of setting in a volume increased dot, as understood from the alternate long and short dash line (c) in FIG. 3(*a*), the following expression is obtained.

$$3M(1-\alpha 2)=N(2\alpha 2-3) \quad \text{Expression (10)}$$

Since $\alpha 2=1.2$, the expression (10) is:

$$\text{"M"}=\text{"N"} \quad \text{Expression (11)}$$

In other words, a dot whose number of liquid droplets is reduced and which is formed of 2 droplets is formed by the abnormal nozzle with the same number as that of a dot formed of 3 droplets, i.e., "N"=1 for "M"=1. Further, in this case, it is preferable that a dot of 3 droplets and a dot of 2 droplets are alternately formed in the line. According to this structure, the number of dots is changed at the highest spatial frequency which is easily averaged even when visually observed and thus the most uniform image quality can be attained appropriately.

For example, in a modeled case as shown in FIG. 4(*b*), as shown in FIG. 5(*b*) which is an enlarged view, in the line 306*f* which is an abnormal nozzle line, with a region 402 including two successive dots as a unit, a corrected dot whose ink volume is "2.4 Io" (2 droplets) formed by the abnormal nozzle and a dot whose ink volume is "3.6 Io" (3 droplets) are alternately formed. According to this structure, as shown in the drawing, occurrence of a striped variation is restrained and an appropriate printing can be performed.

As described above, in this embodiment, the ejection control section 102 (see FIG. 1(*a*)) changes setting of an ink dot size of a part of the dots in the abnormal nozzle line with respect to that in a normal nozzle line. The normal nozzle line is a line which is formed of ink droplets ejected from a normal nozzle. Further, for example, the ejection control section 102 changes setting of an ink dot size by changing an ejection control signal supplied to the nozzle in correspondence with a part of the dots from a case of a normal nozzle line. In this manner, the ejection control section 102 brings an average value of errors of ink dot sizes in the abnormal nozzle line close to zero in comparison with a case that the setting of an ink dot size of all dots is the same as that in a normal nozzle line.

As described above, in this embodiment, in the ink volume of a dot formed by the abnormal nozzle, an average value of a plurality of dots which are juxtaposed in a moving direction of the inkjet head can be brought close to the ink volume of a normal nozzle appropriately. As a result, occurrence of a striped variation is restrained and high quality printing can be performed appropriately. Further, in this correction, a change of an ejecting amount from the abnormal nozzle is executed by utilizing a gradation control function (half tone reproduction capability) of the inkjet head which is required for multi-gradation printing. Therefore, according to this embodiment, for example, correction can be easily and appropriately executed without adding a complicated function and structure in the inkjet printer.

In this embodiment, the ejection control section 102 (see FIG. 1(*a*)) controls the respective inkjet heads 104, for example, depending on printing image data received from the image forming device 14, thereby each nozzle of the inkjet head 104 performs printing in a state that the above-mentioned correction is executed. In this case, for example, the image forming device 14 forms printable data in which an ink dot size of a part of the dots in the line formed by the abnormal nozzle is changed in correspondence with a corrected result on the basis of the nozzle information. The ejection control section 102 may receive printable data in which a result of the correction is not reflected from the image forming device 14. In this case, the ejection control section 102 further manages nozzle information and the above-mentioned correction is executed on the basis of the printable data and the nozzle information.

In the embodiment described above, the number of gradation is 6 gradations including zero (0) in which an ink droplet is not ejected. However, correction similar to the above-mentioned embodiment can be executed on a structure which is capable of ejecting ink droplets corresponding to at least two ink volumes (3 gradations or more including zero). For example, in a case that only ink droplets corresponding to two ink volumes are to be ejected (in a case of 3 gradations including zero), ink volume corresponding to the smallest dot size is set as a starting point and all corrections are executed so that ink volume is increased, thereby the correction can be executed appropriately.

In order to easily execute the correction, it is desirable that ink droplets corresponding to at least three or more levels of ink volume are capable of being ejected (4 gradations or more including zero). In this case, for example, correction is executed with the center of ink dot sizes (or ink volume value) as a reference, thereby appropriate correction can be further easily executed.

Further, in the embodiment described above, the total value of "N" and "M", i.e., (M+N) which is the maximum correction number of "N" and "M" is 11. However, in a case that an average value of ejection errors after correction (correction error) is not decreased sufficiently in the maximum correction number, for example, correction may be executed again so that the correction error is brought close to zero between adjacent regions of the correction unit. According to this structure, accuracy of correction can be further appropriately enhanced.

Further, the ejection control section 102 may calculate an average value of each of plural levels of an ink dot size as the average value of the ejection error. In this case, for example, the ejection control section 102 makes an average value of ejection errors corresponding to each of ink dot sizes bring close to zero. Further, for example, the ejection control section 102 may select a region in which dots having the same ink dot size are successively juxtaposed each other by a predetermined number or more and the correction is executed for the region.

Further, in the embodiment described above, the number of liquid droplets which are ejected is changed as a method for modulating an ink dot size in order to represent half tone. However, another method may be used as a method for modulation. For example, in a case that an inkjet head 104 in a piezo-system is used, modulation of an ink dot size may be executed by a pulse width of a drive waveform or a combination of timing of a pushing waveform and a pulling waveform for ink.

Further, for example, in a case that ink volume is to be adjusted in a relatively small extent, modulation of the ink dot size may be executed by varying a voltage of the ejection control signal. Also in this case, for example, when variation of an ejection characteristic of an abnormal nozzle is small, correction may be executed by directly varying the volume of an ink droplet by varying the voltage.

Although the present invention has been shown and described with reference to a specific embodiment, the technical scope of the present invention is not limited to the embodiment described above. Various changes and modifications will be apparent to those skilled in the art from the teachings herein. It is clear from the description of the following claims that embodiments to which the various changes and modifications are applied are included in the technical scope of the present invention.

INDUSTRIAL APPLICABILITY

The present invention is, for example, preferably utilized in an inkjet printer.

REFERENCE SIGNS LIST

10 . . . printing system, 12 . . . inkjet printer, 14 . . . image forming device, 50 . . . medium, 102 . . . ejection control section, 104 . . . inkjet head, 106 . . . dot visual confirmation part, 202 . . . nozzle row, 204 . . . nozzle, 304 . . . dot, 306*a* through 306*j* . . . line, 308*a*, 308*b* . . . line group, 402 . . . region

The invention claimed is:

1. An inkjet printer in which ink dot sizes on a medium are modulated in plural levels to perform multi-gradation printing, the printer comprising:

an inkjet head including nozzles for ejecting ink droplets while the inject head is moving in a line direction relative to the medium; and an ejection control section for controlling ejection of the ink droplets from the nozzles by providing ejection control signals to the nozzles;

wherein the inkjet head forms dot lines in a direction perpendicular to the line direction in a juxtaposed manner in which the ink dots are juxtaposed in the line direction;

wherein the inkjet head forms dots of the same color by ejecting the ink droplets from one of the nozzles corresponding to a respective dot line in each of the dot lines;

wherein, when one of the ink droplets is ejected from the one of the nozzles, the ejection control section provides one of the ejection control signals corresponding to an ink dot size for the one of the nozzles, and the one of the nozzles ejects the ink droplet corresponding to the one of the ejection control signals from the ejection control section to provide an ink dot having the ink dot size corresponding to the one of the ejection control signals;

wherein the ejection control section changes control of the ejection of the ink droplets depending on whether one of the nozzles for forming the respective dot line is an abnormal nozzle, which is characterize by an ejection error representing a difference between a volume of the ink droplet ejected and a predetermined standard value selected from a permitted range, or the election control section changes control of the ejection of the ink droplets depending on whether one of the nozzles for forming the respective dot line is a normal nozzle, which is characterized by an ejection error within the permitted range;

wherein the ejection control section supplies the abnormal nozzle an ejection control signal corresponding to an ink dot size for a part of the ink dots juxtaposed in the respective line different from the ejection control signal supplied for an ink dot size for a part of the ink dots juxtaposed in the respective line for the normal nozzle; and wherein the ejection control section supplies the abnormal nozzle an ejection control signal different from the ejection control signal for the normal nozzle that is characterized by an average value in the respective dot line of the ejection errors that is minimized close to zero in comparison with a case that the ejection control signal for the normal nozzle is supplied as the ejection control signal corresponding to all of the ink dots in the respective dot line.

2. The inkjet printer according to claim 1, wherein in a case that a volume of the ink droplet ejected from the one of the nozzles is larger than the standard value, the ejection control section supplies the one of the nozzles an ejection control signal corresponding to an ink dot size smaller than the ink dot size in the normal nozzle corresponding to the part of the ink dots juxtaposed in the line; and wherein in a case that a volume of the ink droplet ejected from the abnormal nozzle is smaller than the standard value the ejection control section supplies the one of the nozzles an ejection control signal corresponding to an ink dot size larger than the ink dot size in the normal nozzle corresponding to the part of the ink dots juxtaposed in the line.

3. The inkjet printer according to claim 1, wherein the ejection control section divides a line formed by the abnormal nozzle into a plurality of regions including a plurality of the ink dots, and wherein an average value of the ejection errors in each of the plurality of regions is minimized close to zero.

4. The inkjet printer according to 2, wherein the ejection control section divides a line formed by the abnormal nozzle into a plurality of regions including a plurality of the ink dots, and wherein an average value of the ejection errors in each of the plurality of regions is minimized close to zero.

5. A printing method in which an ink dot size formed on a medium by ejecting an ink droplet is modulated in plural levels to perform multi-gradation printing, comprising:

ejecting ink droplets from inkjet head nozzles while moving the inkjet head nozzles in a line direction with respect to the medium; and supplying an ejection control signal to one of the nozzles for controlling ejection of the ink droplets from the one of the nozzles;

wherein the inkjet head forms lines of ink dots in a direction perpendicular to the line direction in a juxtaposed manner, and the inkjet head forms the ink dots in each of the lines having the same color by ejecting the ink droplets from one of the nozzles corresponding to a respective line of ink dots;

wherein the ejection control signal corresponds to a level of the ink dot size supplied to the one of the nozzles, and the one of the nozzles ejects the ink droplets depending on the ejection control signal;

wherein control of ejection of the ink droplets is changed depending on whether the one of the nozzles for forming the respective line is an abnormal nozzle, which is characterized by an ejection error representing a difference between a volume of the ink droplet ejected and a predetermined standard value selected from a permitted range, or control of ejection of the ink droplets is changed depending on whether the one of the nozzles for forming the respective line is a normal nozzle, which is characterized by an ejection error within the permitted range;

wherein the ejection control signal corresponding to the ink dot size for a part of the ink dots juxtaposed each other in the respective line supplied for the abnormal nozzle is different from the ejection control signal corresponding to the ink dot size for a part of the dots juxtaposed each other in the respective line formed by the normal nozzle; and wherein the ejection control signal supplied for the abnormal nozzle is different from the normal nozzle that is characterized by an average value in the respective line of the ejection errors that is minimized close to zero in comparison with a case that the ejection control signal for the normal nozzle is supplied as the ejection control signal corresponding to all of the dots in the respective line.

6. A manufacturing method for a printed product in which an ink dot size formed on a medium by ejecting an ink droplet is modulated in plural levels to perform multi-gradation printing in an inkjet method to manufacture a printed product, comprising:

ejecting ink droplets from inkjet head nozzles while moving the inkjet head nozzles in a line direction with respect to the medium; and supplying an ejection control signal to one of the nozzles for controlling ejection of the ink droplets from the one of the nozzles;

wherein the inkjet head forms lines of ink dots in a direction perpendicular to the line direction in a juxtaposed manner, and the inkjet head forms the ink dots in each of the lines having the same color by ejecting the ink droplets from one of the nozzles corresponding to a respective line of ink dots;

wherein the ejection control signal corresponds to a level of the ink dot size supplied to the one of the nozzles, and the one of the nozzles ejects the ink droplets depending on the ejection control signal;

wherein control of ejection of the ink droplets is changed depending on whether the one of the nozzles for forming the respective line is an abnormal nozzle, which is characterized by an ejection error representing a difference between a volume of the ink droplet ejected and a predetermined standard value selected from a permitted range, or control of ejection of the ink droplets is changed depending on whether the one of the nozzles for forming the respective line is a normal nozzle, which is characterized by an ejection error within the permitted range;

wherein the ejection control signal corresponding to the ink dot size for a part of the ink dots juxtaposed each other in the respective line supplied for the abnormal nozzle is different from the ejection control signal corresponding to the ink dot size for a part of the dots juxtaposed each other in the respective line formed by the normal nozzle; and wherein the ejection control signal supplied for the abnormal nozzle is different from the normal nozzle that is characterized by an average value in the respective line of the ejection errors that is minimized close to zero in comparison with a case that the ejection control signal for the normal nozzle is supplied as the ejection control signal corresponding to all of the dots in the respective line.

* * * * *

UNITED STATES PATENT AND TRADEMARK OFFICE

CERTIFICATE OF CORRECTION

PATENT NO. : 8,801,132 B2
APPLICATION NO. : 13/393709
DATED : August 12, 2014
INVENTOR(S) : Masaru Ohnishi It is certified that error appears in the above-identified patent and that said Letters Patent is hereby corrected as shown below:

In the Claims:

Claim 1, col. 19, line 57, "which is characterize by" should read -- which is characterized by --.

Claim 4, col. 20, line 35, "printer according to 2," should read -- printer according to claim 2, --.

Signed and Sealed this
Eighteenth Day of November, 2014

Michelle K. Lee

Michelle K. Lee
*Deputy Director of the United States Patent and Trademark Office*